US007500741B2

(12) United States Patent
Amemiya

(10) Patent No.: US 7,500,741 B2
(45) **Date of Patent: *Mar. 10, 2009**

(54) EXPENDABLE PART, EXPENDABLE PART INSTALLATION STRUCTURE, AND IMAGING APPARATUS

(75) Inventor: Kanae Amemiya, Tokyo (JP)

(73) Assignee: Ricoh Company. Ltd., Tokyo (JP)

( * ) Notice: Subject to any disclaimer, the term of this patent is extended or adjusted under 35 U.S.C. 154(b) by 281 days.

This patent is subject to a terminal disclaimer.

(21) Appl. No.: 11/441,155

(22) Filed: May 26, 2006

(65) Prior Publication Data

US 2006/0215001 A1 Sep. 28, 2006

Related U.S. Application Data

(63) Continuation of application No. 10/941,828, filed on Sep. 16, 2004, now Pat. No. 7,073,898.

(30) Foreign Application Priority Data

Sep. 18, 2003 (JP) ..... 2003-325494
Jul. 30, 2004 (JP) ..... 2004-222933

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS 5,530,531 A 6/1996 Girard
5,975,688 A 11/1999 Kanaya et al.
6,151,041 A 11/2000 Bolash et al.
6,304,739 B1 10/2001 Katsuyama et al.
6,507,720 B2 1/2003 Kabumoto et al.
6,749,294 B2 * 6/2004 Haldorsen ..... 347/87
2004/0167839 A1 8/2004 Amemiya

FOREIGN PATENT DOCUMENTS

JP 6-765 1/1994
JP 2001-10078 1/2001

* cited by examiner

*Primary Examiner*—Thinh H Nguyen
(74) *Attorney, Agent, or Firm*—Oblon, Spivak, McClelland, Maier & Neustadt, P.C.

(57) ABSTRACT

In an expendable part installation structure and an imaging apparatus implementing such a structure, both disclosed herein, identification features for identifying an expendable part and its corresponding setting part are improved and a replacement procedure for replacing an expendable part is facilitated. A carriage in an ink jet printer includes plural setting parts that are provided with solid portions. Ink cartridges that are arranged to be set to the setting parts are also provided with solid portions. The number of protrusions provided at the solid portion of a setting part is arranged to equal the number of protrusions provided at the solid portion of a corresponding ink cartridge to facilitate identification of a match between the parts. For example, it may be easily determined that an ink cartridge with one protrusion is arranged to be set to a setting part with one protrusion. The solid portions may be easily recognized through touch, and thereby, setting positions of the ink cartridges may be easily determined.

24 Claims, 6 Drawing Sheets

EXPENDABLE PART, EXPENDABLE PART INSTALLATION STRUCTURE, AND IMAGING APPARATUS

CROSS-REFERENCE TO RELATED APPLICATIONS

This application is a continuation of and claims the benefit of priority from U.S. Ser. No. 10/941,828, filed Sep. 16, 2004 and is based upon and claims the benefit of priority under 35 U.S.C. § 119 from Japanese Patent Applications No. 2003-325494, filed Sep. 18, 2003, and No. 2004-222933, filed Jul. 30, 2004, the entire contents of each are incorporated herein by reference.

BACKGROUND OF THE INVENTION

1. Field of the Invention

The present invention relates to an expendable part such as an ink cartridge or a toner bottle that may be installed, used and replaced in an imaging apparatus. The present invention also relates to an expendable part installation structure that accommodates the expendable part, and an imaging apparatus implementing the expendable part installation structure accommodating the expendable part.

2. Description of the Related Art

In an imaging apparatus such as a color ink jet printer, an ink head having plural ink cartridges set to plural setting parts inside a box structure of the imaging apparatus is provided to thereby enable color printing of text and images on paper.

According to the conventional art, plural ink cartridges having identical shapes are arranged in a color printer, and thereby, the setting part of the ink head to which an ink cartridge of a specific color is to be set (installed) may be identified by matching a number or a color decal between the setting part and the ink cartridge, for example.

However, the identification method described above may be inconvenient for visually impaired persons or persons with impaired color vision. Accordingly, many imaging apparatuses implement fool-proof functions (structures) to prevent a user from setting an ink cartridge in a wrong position.

Nevertheless, the fool-proof measures implemented in the conventional art do not provide a user with prior knowledge as to which position an ink cartridge is to be set. Specifically, in the prior art, a user may only determine that he/she has set an ink cartridge in a wrong position after actually inserting the ink cartridge into the wrong setting position to thereby find out that the ink cartridge does not fit into the setting position.

Accordingly, the ink cartridge replacement procedure of the prior art imposes a significant burden on a visually impaired person, and even creates an inconvenience for a non-visually impaired person when he/she attempts to replace the ink cartridge in a dark environment such as under a desk.

SUMMARY OF THE INVENTION

The present invention has been conceived in response to one or more problems of the related art, and its object is to facilitate identification and setting of an expendable part such as an ink cartridge.

It is noted that an expendable part referred to in the present application may include expendable items other than an ink cartridge such as a toner bottle, a process cartridge, an ink ribbon cartridge and other replenishment items.

A specific object of the present invention is to provide an expendable part of an imaging apparatus that is replaceable and corresponds to one of plural colors, the expendable part including:

an external surface on which a first solid portion for identifying the corresponding one of the colors is provided;

wherein a configuration of the first solid portion is arranged to be similar or substantially identical to a configuration of a second solid portion that is provided on an exposed surface of a setting part of the imaging apparatus for setting the expendable part in place.

It is another specific object of the present invention to provide an expendable part installation structure, including:

plural expendable parts that are replaceable and correspond to plural colors; and an installation body including plural setting parts corresponding to installation positions of the expendable parts;

wherein at least one of the expendable parts has an external surface on which a first solid portion for identifying a corresponding one of the colors is provided; and at least one of the setting parts corresponding to an installation position of the at least one of the expendable parts has an exposed surface on which a second solid portion for setting the corresponding expendable part in place is provided;

the first solid portion and the second solid portion being arranged to have similar or substantially identical configurations.

It is another specific object of the present invention to provide an imaging apparatus implementing an expendable part of the present invention or an expendable part installation structure of the present invention.

According to a preferred embodiment of the present invention, the first solid portion and the second solid portion are arranged to include the same number of solid figures.

According to another preferred embodiment, the first solid portion includes one or more protrusions.

According to another preferred embodiment, the first solid portion includes one or more concave portions.

According to another preferred embodiment, the second solid portion includes one or more protrusions.

According to another preferred embodiment, the second solid portion includes one or more concave portions.

According to another preferred embodiment, the expendable part corresponds to an ink cartridge.

According to another preferred embodiment, the expendable part corresponds to an ink ribbon cartridge.

According to another preferred embodiment, the configurations of the first solid portion and the second solid portion differ according to an ink color of the ink cartridge/ribbon cartridge.

According to another preferred embodiment, the expendable part corresponds to a toner bottle.

According to another preferred embodiment, the expendable part corresponds to a process cartridge.

According to another embodiment, the configurations of the first solid portion and the second solid portion differ according to a toner color of the toner bottle/process cartridge.

BRIEF DESCRIPTION OF THE DRAWINGS

FIGS. 3A~3D are diagrams illustrating an embodiment of the present invention, wherein FIGS. 3A and 3B are respectively a front view and a cross-sectional view of setting parts of a carriage for setting ink cartridges in place, and FIGS. 3C and 3D are respectively a front view and a cross-sectional view of the ink cartridges.

DESCRIPTION OF THE PREFERRED EMBODIMENTS

In the following, preferred embodiments of the present invention are described with reference to the accompanying drawings. It is noted that in the following description, an embodiment using an ink cartridge as an expendable part is illustrated as an example. However, the present invention is not limited to this embodiment, and for example, a toner bottle, an ink ribbon cartridge, a process cartridge that integrates components such as a developing unit and a photo conductor unit into a single unit, and other various types of expendable items, replaceable items, and replenishment items may be used as an expendable part that may be installed and removed from an imaging apparatus or some other type of apparatus.

Figure 1:
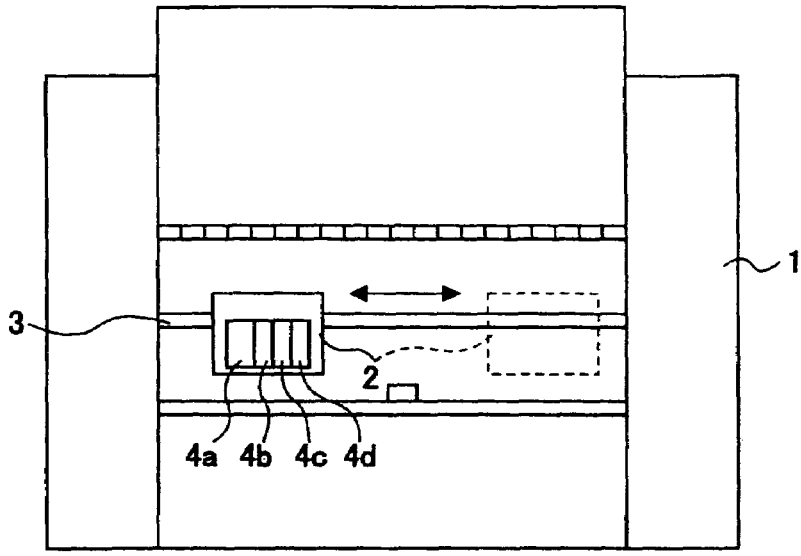
FIG. 1 is a cross-sectional view showing an exemplary configuration of an imaging apparatus that implements an expendable part installation structure according to an embodiment of the present invention.

FIG. 1 is a front cross-sectional view of an imaging apparatus that implements an expendable part installation structure according to an embodiment of the present invention.

According to the present embodiment, the imaging apparatus corresponds to an ink jet printer having a box structure 1 that includes, for example, a paper feeder unit having a paper feeder tray and a paper feeder roller; a guide unit that guides paper to be transferred; a carriage 2 having a print head for printing an image or text on paper; a paper delivery unit having a delivery roller for delivering printed paper, for example; and a delivery tray that stocks delivered paper.

In the example of FIG. 1, the carriage 2 has a print head arranged at its bottom portion, and is supported by a guide 3 to move back and forth in horizontal directions. The carriage 2 may accommodate four ink cartridges 4*a*~4*d* corresponding to four colors, cyan, magenta, yellow, and black, for example. It is noted that the ink cartridges may be detached and replaced.

Figure 2:
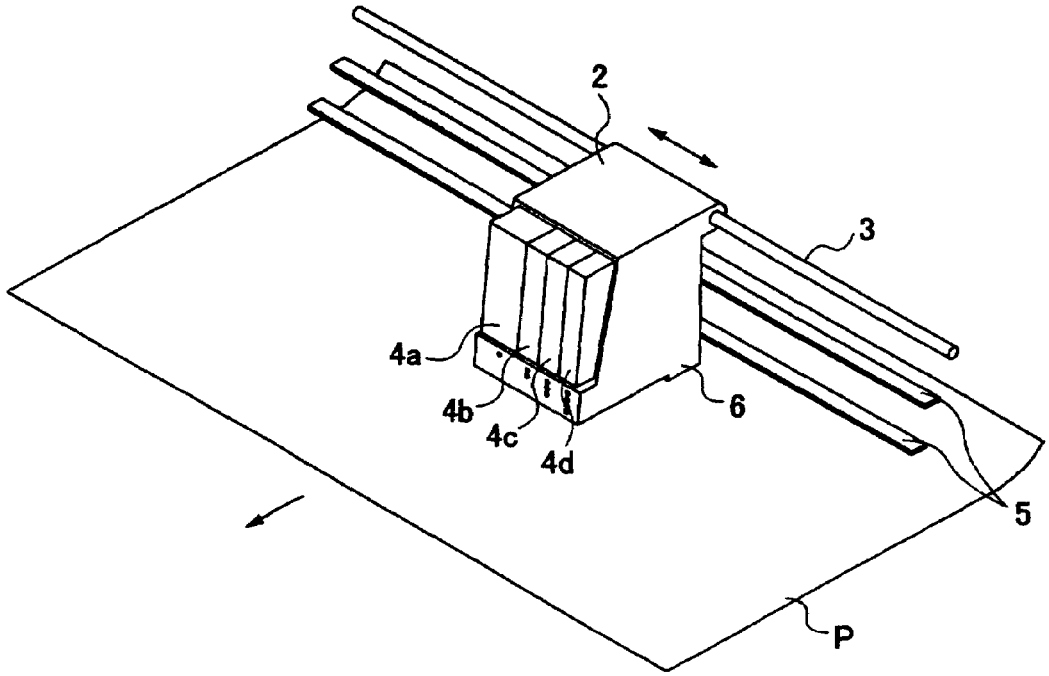
FIG. 2 is a perspective view of a carriage and its surrounding parts of the imaging apparatus shown in FIG. 1.

FIG. 2 is a perspective view showing the carriage 2 and surrounding portions thereof. In the present example, the guide 3 is arranged to be parallel to an axis of a paper sending roller (not shown) for sending paper P, and this guide 3 together with a timing belt 5 that is arranged over and around a pair of pulleys (not shown) realize a drive mechanism of the carriage 2. The carriage 2 is driven back and forth along the guide 3 in the width direction of the paper P by the timing belt 5 that is driven by a motor (not shown). In FIG. 2, a print head 6 is arranged at a bottom portion of the carriage 2, and printing on paper P may be realized by this print head 6.

Figure 3A:
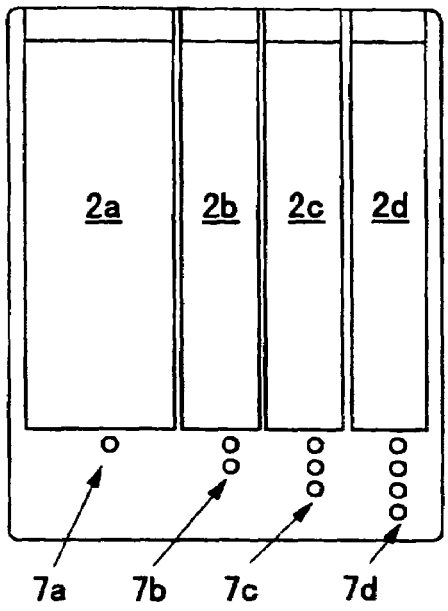
Figure 3B:
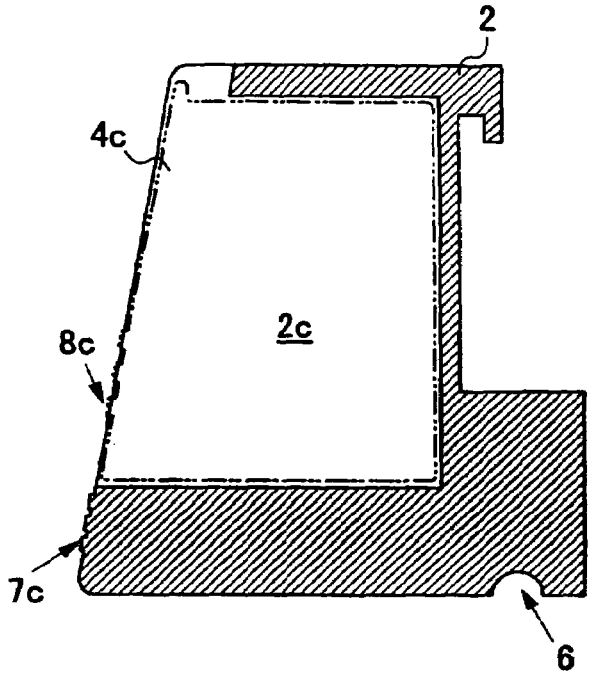
Figure 3C:
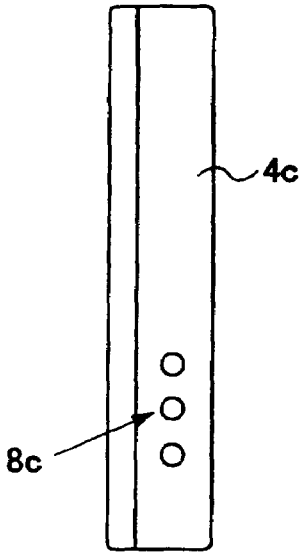
Figure 3D:
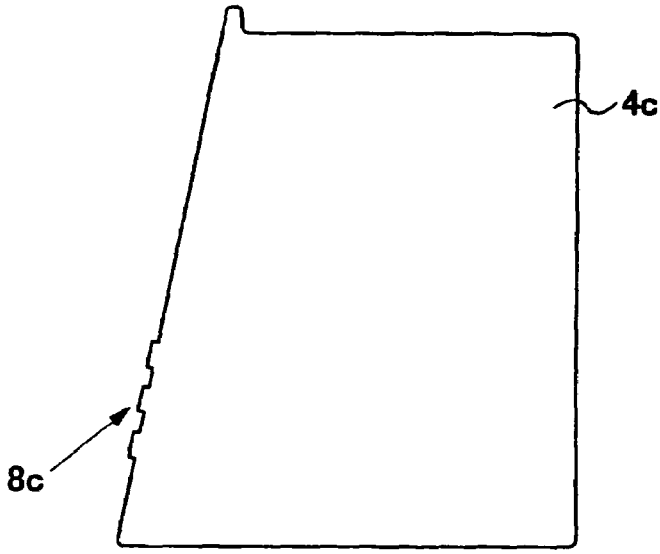

FIGS. 3A~3D illustrate configurations of an expendable part installation structure and an expendable part according to an embodiment of the present invention. FIGS. 3A and 3B are respectively a front view and a cross-sectional view showing setting parts 2*a*~2*d* for the ink cartridges 4*a*~4*d*. FIGS. 3C and 3D are respectively a front view and a side view of the ink cartridges 4*a*~4*d*. It is noted that in FIGS. 3B~3D, the setting part 2*c* and the ink cartridge 4*c* are illustrated as representative configurations of a setting part and an ink cartridge; that is, the other setting parts 2*a*, 2*b* and 2*d*, and the other ink cartridges 4*a*, 4*b*, and 4*d* may also have structures and shapes identical to those of the setting part 2*c* and the ink cartridge 4*c*.

Setting parts 2*a*~2*d* respectively have shapes that correspond to the shapes of the ink cartridges 4*a*~4*d* so that the ink cartridges 4*a*~4*d* may be suitably inserted, accommodated and disengaged. In the cross-sectional views of FIGS. 3B and 3D, the setting part 2*c* and the ink cartridge 4*c* are illustrated as having trapezoidal shapes; however, the present invention is not limited to this exemplary structure. Also, in the present drawings, the print head 6 and its internal structure are not shown. In the present example, solid portions 7*a*~7*d* that may be recognized through touch are respectively provided at lower sections of front surfaces of the setting parts 2*a*~2*d* that correspond to sloped surfaces. The solid portions 7*a*~7*d* are arranged at the sloped surface at the lower front side of the setting parts 2*a*~2*d* so that they may be easily touched and identified upon disengaging the ink cartridges 4*a*~4*d*.

According to one embodiment, the solid portions 7*a*~7*d* correspond to protrusions, and the number of protrusions formed at the sloped front surfaces of the setting parts 2*a*~2*d* differ according to their corresponding solid portions 7*a*~7*d*. In the example shown in FIGS. 3A and 3B, the solid portion 7*a* has one protrusion, the solid portion 7*b* has two protrusions, the solid portion 7*c* has three protrusions, and the solid portion 7*d* has four protrusions.

Also, according to the present example, the ink cartridges 4*a*~4*d* have front surfaces that are substantially rectangular, and side surfaces that have trapezoidal shapes that correspond to the shapes of the setting parts 2*a*~2*d*. Further, solid portions 8*a*~8*d* that may be recognized through touch are respectively provided at the lower sections of the front surfaces of the ink cartridges 4*a*~4*d* that correspond to sloped surfaces. It is noted that the ink cartridges 4*a*~4*d* are inserted and pushed into the setting parts 2*a*~2*d* to be set thereto, and thereby, surfaces of the ink cartridges 4*a*~4*d* other than their front surfaces tend to be covered by other parts upon installation of the ink cartridges 4*a*~4*d*. Accordingly, the solid portions 8*a*~8*d* are preferably arranged at the sloped front surfaces of the ink cartridges 4*a*~4*d* so that they may be recognized during installation. However, the solid portions 8*a*~8*d* may also be provided in some other area except for the areas around the points at which the inks are discharged. In other words, the solid portions 8*a*~8*d* of the ink cartridges 4*a*~4*d* may be arranged at suitable positions with regard to the features and structure of the imaging apparatus into which the ink cartridges 4*a*~4*d* are installed.

According to one embodiment, the solid portions 8*a*~8*d* correspond to protrusions, and the solid portions 8*a*~8*d* are each arranged to have a different number of protrusions. In the example shown in FIGS. 3C and 3D, the solid portion 8*a* has one protrusion, the solid portion 8*b* has two protrusions, the solid portion 8*c* has three protrusions, and the solid portion 3*d* has four protrusions.

In the illustrated example, the solid portions 7*a*~7*d* of the setting parts 2*a*~2*d* are arranged to have the same number of protrusions as their respective corresponding solid portions 8*a*~8*d* of the ink cartridges 4*a*~4*d* so that their correspondence may be easily recognized. Specifically, it may be determined that the ink cartridge 4*a* with one protrusion (solid portion 7*a*) is to be set to the setting part 2*a* with one protrusion (solid portion 8*a*), and the same applies to the ink cartridges 4*b*~4*d* and setting parts 2*b*~2*d*. Since the correspondence between the solid portions 7*a*~7*d* and the solid portions 8*a*~8*d* may be easily recognized through touch in the present example, the setting positions of the ink cartridges 4*a*~4*d* may be easily identified.

Figure 4:
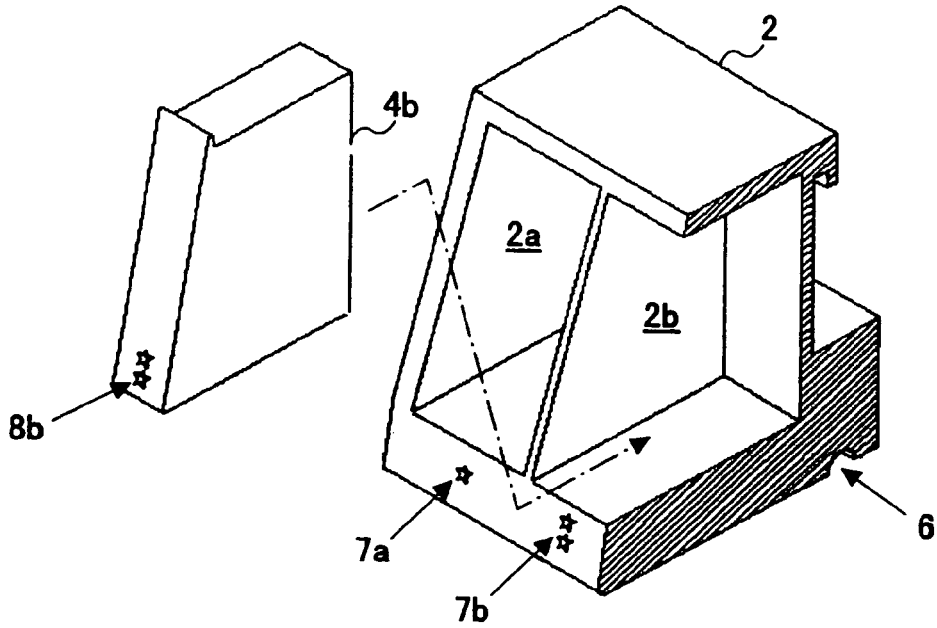
FIG. 4 is a perspective view showing an exemplary configuration of solid portions that are provided on the ink cartridges and setting portions.
Figure 5:
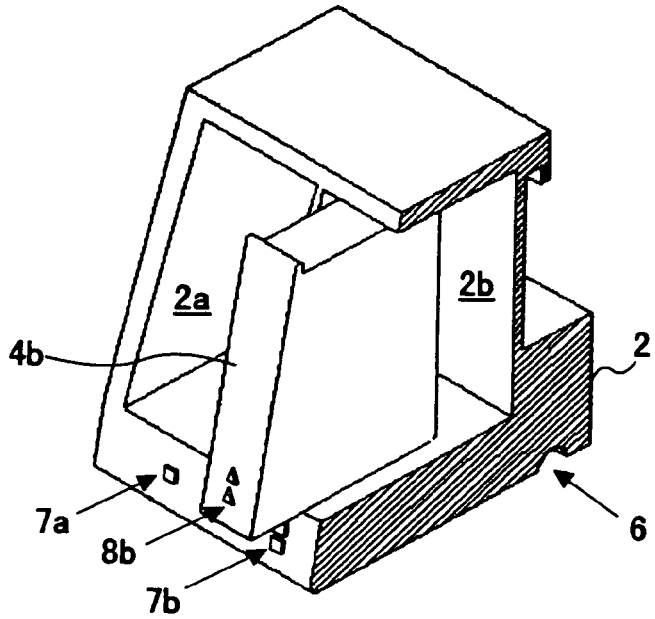
FIG. 5 is a perspective view showing another exemplary configuration of solid portions that are used in matching the ink cartridges and the setting portions.
Figure 6:
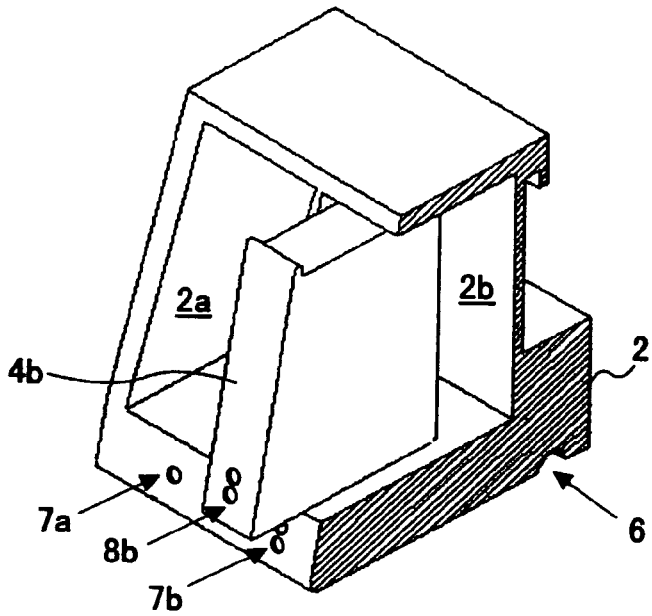
FIG. 6 is a perspective view showing another exemplary configuration of solid portions which take the form of small concave-shaped holes.
Figure 7:
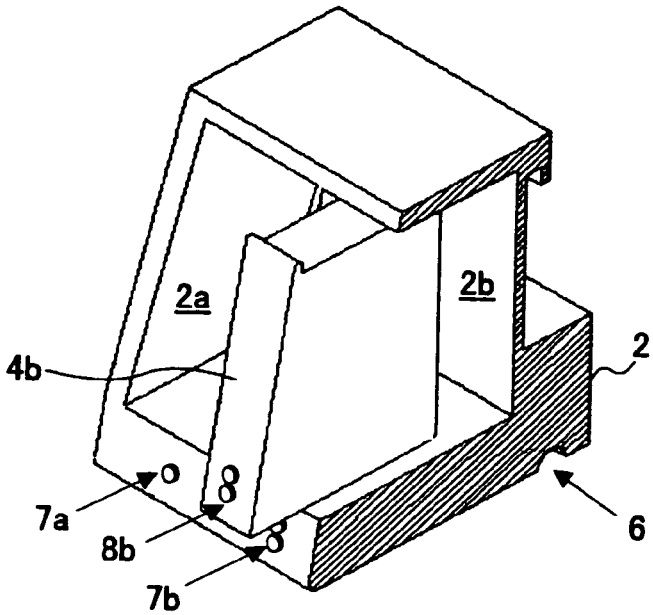
FIG. 7 is a perspective view showing another exemplary configuration of solid portions which take the form of concave and convex shapes.

It is noted that the solid shapes are used to enable a user to match the ink cartridges 4*a*~4*d* to the setting parts 2*a*~2*d*. Accordingly, the solid portions may take the form of other figures and shapes such as star shapes, as is illustrated in FIG. 4; a combination of various shapes such as triangular shapes and rectangular shapes to realize matching through shape recognition, as is illustrated in FIG. 5; concave shapes such as small holes where the number of the holes correspond, as is illustrated in FIG. 6; and a combination of convex shapes and concave shapes as is illustrated in FIG. 7.

Braille is known as a touch-based information system for visually impaired persons; however, it may be more effective to provide a simple arrangement in which recognition of a correspondence between parts may be enabled through matching of simple solid shapes so that visually impaired persons not having knowledge of the Braille system (the Braille literacy rate is very low) or even non-visually impaired persons may be able to make use of the arrangement. In other words, by providing highly relevant solid shapes to each pair of the ink cartridges and their corresponding setting parts, identification information through alternative measures may be provided in addition to the primarily vision-based identification information of the conventional art.

Figure 8A:
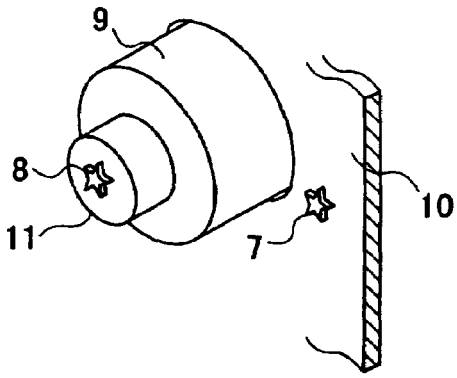
FIGS. 8A and 8B are a perspective views showing exemplary configurations of solid portions in a case where the expendable part corresponds to a toner bottle.
Figure 8B:
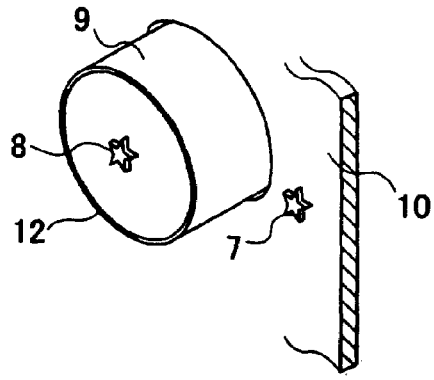

FIGS. 8A and 8B are perspective views showing exemplary configurations of a solid portion in a case where the expendable part corresponds to a toner bottle 9.

In a case where a toner bottle 9 is used as the expendable part, solid portions 7 and 8 may respectively be provided at a section of an installation part 10 close to an installation position of the toner bottle 9, and a section of the toner bottle 9 that is positioned close to the installation part 10 when it is installed thereto. For example, the solid portion 8 may be provided on a cap 11 of the toner bottle 9 as is shown in FIG. 8A, a cover of the toner bottle, or a bottom portion 12 of the toner bottle as is shown in FIG. 8B. According to one embodiment, the solid portions may be arranged to have different shapes according to different colors while the number of the solid shapes being provided may be the same.

Figure 9:
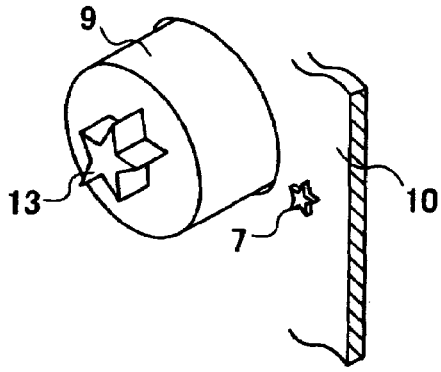
FIG. 9 is a perspective view showing another exemplary configuration of solid portions that correspond to the external shape of a cap in the case of using a toner bottle as the expendable part.
Figure 10:
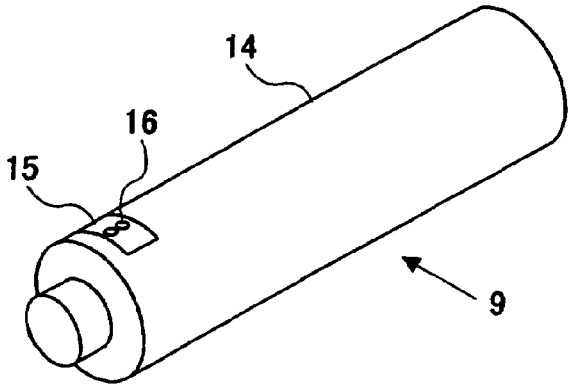
FIG. 10 is a perspective view showing another example of providing suitable solid portions on a body of the toner bottle.

In an example as is illustrated in FIG. 9, the solid portion provided at the toner bottle 9 may take the form of the external shape of a cap 13 or some other part of the toner bottle 9. In another example as is illustrated in FIG. 10, the solid portion of the toner bottle 9 may take the form of a suitable shape such as a small protrusion that is provided on a label 15 attached to a section of the lengthwise extending body of the toner bottle 9 so that the toner bottle 9 may be identified upon picking up the toner bottle 9 during a replacement process.

Figure 11:
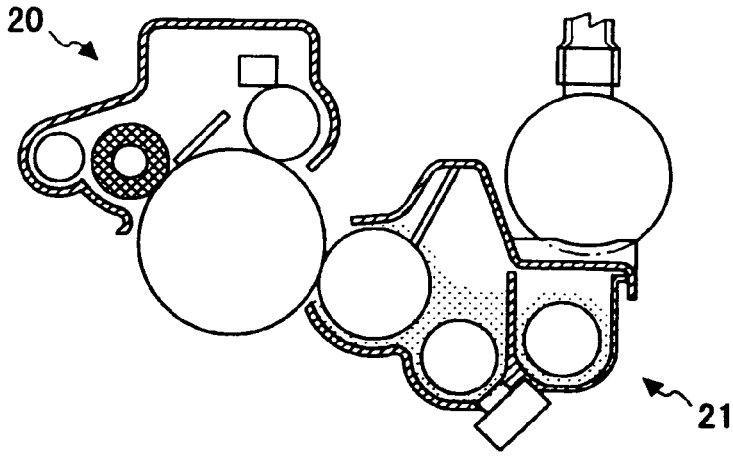
FIG. 11 is a schematic view showing a case in which the expendable part corresponds to a process cartridge.

FIG. 11 illustrates a case in which the expendable part corresponds to a process cartridge. In this case, the imaging apparatus has a suitable solid portion provided at a lever, a portion close to a part for engaging the process cartridge (e.g., a door that opens and closes upon engaging/disengaging the cartridge), or a portion close to an operations panel of the imaging apparatus. The process cartridge preferably has a solid shape provided on a grip part or an area where a label is attached. In the example of FIG. 11, the process cartridge is divided into a photo conductor unit 20 and a developing unit 21; however, the present invention is also applicable to other various types of process cartridges including that integrated into a single unit, for example.

Figure 12:
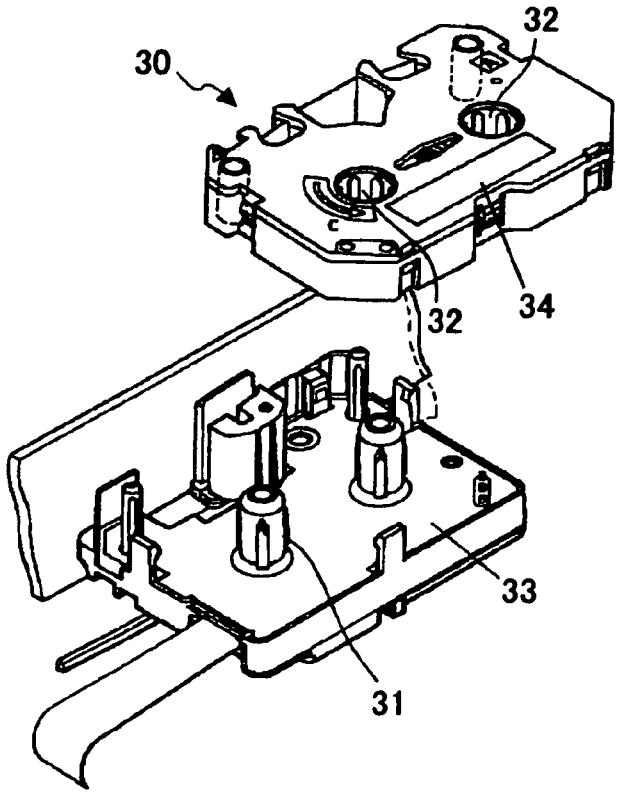
FIG. 12 is a perspective view showing a case in which the expendable part corresponds to an ink ribbon cartridge.

FIG. 12 shows a case in which the expendable part corresponds to an ink ribbon cartridge. According to this example, an ink ribbon cartridge 30 has a hole 32 so that it may be engaged by a drive axis 31, and the imaging apparatus such as a printer has a suitable solid shape provided on a surface 33 facing the hole 32 or on the opposite side of the hole 32. Also, the ink ribbon cartridge 30 may have a solid shape provided on an area 34 where a label is placed. It is noted that the present invention is also applicable to other various types of ink ribbon cartridges.

Further, it is noted that the present invention is not limited to the embodiments described above, and variations and modifications may be made without departing from the scope of the present invention. For example, in an ink cartridge that is adapted to visually indicate to the outside that ink has run out, a solid shape for indicating such ink-out state may be provided on a surface of this ink cartridge where the visual ink-out state indication is provided, preferably in the vicinity of this visual indication.

The present application is based on and claims the benefit of the earlier filing date of Japanese Patent Application No. 2003-325494 filed on Sep. 18, 2003, and Japanese Patent Application No. 2004-222933 filed on Jul. 30, 2004, the entire contents of which are hereby incorporated by reference.

What is claimed is:

1. An expendable part of an apparatus that is replaceable and corresponds to one of a plurality of types of the expendable parts, the expendable part comprising:

an external surface on which a first protrusion for identifying the corresponding one of the types the expendable parts is arranged;

wherein a configuration of the first protrusion is arranged to be substantially identical to a configuration of a second protrusion that is arranged on an exposed surface of the apparatus having a setting part for setting the expendable part in place.

2. The expendable part as claimed in claim 1, wherein the first protrusion and the second protrusion are arranged to include a same number of protruding figures.

3. The expendable part as claimed in claim 1, comprising: an ink cartridge.

4. The expendable part as claimed in claim 3, wherein the configuration of the first protrusion varies depending on an ink color of the ink cartridge.

5. The expendable part as claimed in claim 1, comprising: an ink ribbon cartridge.

6. The expendable part as claimed in claim 5, wherein the configuration of the first protrusion varies depending on an ink color of the ink ribbon cartridge.

7. The expendable part as claimed in claim 1, comprising: a toner bottle.

8. The expendable part as claimed in claim 7, wherein the configuration of the first protrusion varies depending on a toner color of the toner bottle.

9. The expendable part as claimed in claim 1, comprising: a process cartridge.

10. The expendable part as claimed in claim 9, wherein the configuration of the first protrusion varies depending on a toner color of the process cartridge.

11. An expendable part installation structure, comprising:

an installation body including a plurality of setting parts corresponding to installation positions of a plurality of expendable parts, which parts are replaceable and correspond to a plurality of types of the expendable parts;

wherein at least one of the expendable parts has an external surface on which a first protrusion for identifying a corresponding one of the types of the expendable parts is provided; and at least one of the setting parts corresponding to an installation position of the at least one of the expendable parts has an exposed surface on which a second protrusion used for setting the corresponding expendable part in place is provided;

the first protrusion and the second protrusion being arranged to have similar or substantially identical configurations.

12. The expendable part installation structure as claimed in claim 11, wherein the first protrusion and the second protrusion are arranged to include a same number of solid figures.

13. The expendable part installation structure as claimed in claim 11, wherein the first protrusion of the expendable part includes one or more protrusions.

14. The expendable part installation structure as claimed in claim 11, wherein the second protrusion includes one or more protrusions.

15. The expendable part installation structure as claimed in claim 11, wherein the expendable parts correspond to ink cartridges used in an imaging apparatus.

16. The expendable part installation structure as claimed in claim 15, wherein the configurations of the first protrusion and the second protrusion differ according to ink colors of the ink cartridges.

17. The expendable part installation structure as claimed in claim 11, wherein the expendable parts correspond to ink ribbon cartridges used in an imaging apparatus.

18. The expendable part installation structure as claimed in claim 17, wherein the configurations of the first protrusion and the second protrusion differ according to ink colors of the ink ribbon cartridges.

19. The expendable part installation structure as claimed in claim 11, wherein the expendable parts correspond to toner bottles used in an imaging apparatus.

20. The expendable part installation structure as claimed in claim 19, wherein the configurations of the first protrusion and the second protrusion differ according to toner colors of the toner bottles.

21. The expendable part installation structure as claimed in claim 11, wherein the expendable parts correspond to process cartridges used in an imaging apparatus.

22. The expendable part installation structure as claimed 21, wherein the configurations of the first protrusion and the second protrusion differ according to toner colors of the process cartridges.

23. An imaging apparatus, comprising:

an expendable part that is replaceable and corresponds to one of a plurality of types of expendable parts, the expendable part including an external surface on which a first protrusion for identifying the corresponding one of the types of expendable parts is provided;

wherein a configuration of the first protrusion is arranged to be similar or substantially identical to a configuration of a second protrusion that is provided on an exposed surface of the imaging apparatus having a setting part for setting the expendable part in place.

24. An imaging apparatus comprising:

an expendable part installation structure including an installation body having a plurality of setting parts corresponding to installation positions of a plurality of expendable parts, which parts are replaceable and correspond to a plurality of types of expendable parts;

wherein at least one of the expendable parts has an external surface on which a first protrusion for identifying a corresponding one of the types of expendable parts is provided; and at least one of the setting parts corresponding to an installation position of the at least one of the expendable parts has an exposed surface on which a second protrusion used for setting the corresponding expendable part in place is provided;

the first protrusion and the second protrusion being arranged to have similar or substantially identical configurations.

* * * * *